US007128484B2

(12) United States Patent
Schulken

(10) Patent No.: US 7,128,484 B2
(45) **Date of Patent: *Oct. 31, 2006**

(54) GRIPPING AID

(75) Inventor: Toni M. Schulken, Charlotte, NC (US)

(73) Assignee: Pathways for Learnung Products, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/154,552

(22) Filed: Jun. 17, 2005

(65) Prior Publication Data

US 2005/0232680 A1 Oct. 20, 2005

Related U.S. Application Data

(63) Continuation of application No. 10/826,351, filed on Apr. 19, 2004, now Pat. No. 6,908,245.

(51) Int. Cl.
*A46B 5/02* (2006.01)

(52) U.S. Cl. ..... 401/6; 15/443

(58) Field of Classification Search ..... 401/6, 401/7, 48; 15/435, 443, 444
See application file for complete search history.

(56) References Cited

U.S. PATENT DOCUMENTS

| | | | | |
|---|---|---|---|---|
| 564,178 | A | | 7/1896 | Ahrens |
| D228,418 | S | | 9/1973 | Locke |
| 3,947,977 | A | | 4/1976 | Bishop |
| 4,526,547 | A | | 7/1985 | Rusk |
| 5,143,463 | A | | 9/1992 | Pozil et al. |
| D333,837 | S | * | 3/1993 | Peersmann ..... D19/46 |
| 5,626,430 | A | | 5/1997 | Bistrack |
| 6,254,293 | B1 | | 7/2001 | Citrenbaum |
| 6,328,494 | B1 | | 12/2001 | Moxon |
| 6,554,515 | B1 | | 4/2003 | Debbas |
| 6,773,183 | B1 | | 8/2004 | Geddes et al. |
| 2002/0034411 | A1 | | 3/2002 | Rusk |

FOREIGN PATENT DOCUMENTS

| | | |
|---|---|---|
| SE | 5880 | 10/1894 |

OTHER PUBLICATIONS

Start Right™ Pencil Grip documentation (Mar. 2004).

* cited by examiner

*Primary Examiner*—Huyen Le
(74) *Attorney, Agent, or Firm*—Timothy R. Kroboth

(57) ABSTRACT

A gripping aid to be mounted on a hand-held instrument, is provided that assures a dynamic tripod grasp. The gripping aid beneficially includes generally arched, oppositely extending thumb wrap-preventing rims.

17 Claims, 4 Drawing Sheets

GRIPPING AID

REFERENCE TO EARLIER FILED PATENT APPLICATION

This patent application is a continuation of pending U.S. patent application Ser. No. 10/826,351, filed on Apr. 19, 2004 now U.S. Pat. No. 6,908,245, and entitled "GRIPPING AID".

FIELD OF THE INVENTION

This invention relates to an aid for proper gripping of a hand held instrument.

BACKGROUND OF THE INVENTION

Persons and in particular young children learning how to write, often grip hand held instruments used for writing, drawing and painting improperly. Absent instruction to the contrary, individuals will generally grasp a pencil in a manner that feels the most stable to him or her.

Beginning at age three and through adulthood, the most stable grasp that still allows precision and proper pencil pressure, is a dynamic tripod grasp. The dynamic tripod grasp requires separation of the radial and ulnar sides of the hand. The radial side of the hand, namely the thumb, index finger and middle finger, are generally referred to as the precision side of the hand. The ulnar side of the hand, namely the ring finger and little finger, are referred to as the power side of the hand.

To achieve a dynamic tripod grasp, the individual pinches the instrument between the distal pads of the index finger and thumb, and then rests the instrument on the lateral distal interphalangeal (DIP) joint of the middle finger. These three fingers together are the tripod. These three fingers supported by arches in the palm of the hand, utilize precise movements of rotation, flexion and extension to achieve the small movements needed for letter formation or other fine motor activities requiring accuracy. In addition, the space between the thumb and index finger, namely the web space, must be maintained in an open and circular manner to support the dynamic movements of the tripod fingers. The ulnar side of the hand stays in a flexed and quiet position so as to provide a stable base of support from which the tripod can move.

Many individuals develop improper grasping habits by gravitating towards seemingly more stable grasp patterns at the expense of precision. For example, a common improper grasp pattern is the thumb wrap grasp, in which the thumb overlaps the instrument. The result when using a pencil, is an inactive thumb that pulls in other muscles to compensate, and increased pencil pressure, decreased pencil control and increased hand fatigue when writing. Other common improper grasping patterns include hyperextension at the DIP joints of the thumb and index finger, which causes increased instrument pressure and a tight grasp, resulting in hand fatigue; power grasp in which the instrument is held in a fisted manner with the ulnar side of the hand toward the paper, resulting in decreased precision and increased instrument pressure; four-finger digital grasp in which all four finger pads touch a pencil on one side and the thumb pad opposes the fingers on the other side of the pencil, resulting in decreased pencil control and decreased pencil pressure; and internal rotation and adduction of the thumb, resulting in a closed web space, increased instrument pressure, increased hand fatigue and poor instrument control.

As a result of compensatory grasping patterns, learning how to write properly, legibly, neatly, efficiently, and with enough endurance to complete tasks within a typical time frame, is hindered. Furthermore, efficient use of other hand held instruments is impeded. In addition, thumb and finger joints can be subjected to unnecessary stress.

As exemplified by U.S. Pat. No. 1,879,456 to Parsons, U.S. Pat. No. 4,526,547 to Rusk, U.S. Pat. No. 5,143,463 to Pozil et al, U.S. Pat. No. 5,626,430 to Bistrack, U.S. Pat. No. 6,254,293 to Citrenbaum, and U.S. Des. Pat. No. 228,418, and Patent Application Publications 2002/0034411 to Rusk and 2003/0231917 to Geddes et al, and by the START RIGHT pencil grip, gripping aids, and in particular writing aids, that are mounted on hand held instruments are known. However, no prior art gripping aid is entirely satisfactory.

For example, the asymmetrical Pozil grip, which has an elongated body provided with three concave surface depressions to be grasped by the thumb, index finger and middle finger, and which is commercially made of soft rubber, does not adequately prevent thumb wrap, thumb internal rotation or index finger DIP joint hyperextension. Furthermore, it can be understood from col. 3, lines 51–57, of the Pozil et al patent, that the Pozil grip is intended to reduce dynamic finger movements and increase full hand and arm action. Although that result benefits an arthritic individual, it does not optimally benefit learning how to write properly.

Beneficially, the START RIGHT pencil grip includes a thumb wrap-preventing guard that extends from a proximal body end to a distal body end, and that is generally perpendicular to the throughbore at the distal body end. However, the START RIGHT pencil grip does not assure proper thumb and finger positioning.

There therefore continues to be a need for an improved gripping aid, and in particular a grip that assures proper positioning of the tripod fingers and keeps them in place. Beneficially, the gripping aid would assure fine motor control and dynamic movements of the tripod fingers. Moreover, it would be advantageous if the same gripping aid could be used by left handed and right handed users.

SUMMARY OF THE INVENTION

In accordance with the present invention, there is provided a gripping aid for a hand held instrument, that includes a grip body provided with a bore for receiving the hand held instrument, wherein the bore defines an x-axis of an x-y-z coordinate system. The grip body includes a first longitudinally extending surface that includes a generally concave surface located relatively near a distal end of the body, and advantageously a raised surface located relatively near a proximal end of the body and that is relatively more elevated than the generally concave surface.

Beneficially, the grip body further includes a is first thumb wrap-preventing rim that extends generally in a z-direction from a border of a raised ridge, wherein the ridge border is elevated in a y-direction relative to the x-axis. Advantageously, the rim is generally arched, and is relatively more elevated in the y-direction, near the distal body end than near the proximal body end.

Beneficially, the generally concave surface of the first longitudinally extending surface, rises in the direction of the rim to form a lesser rim that serves as a finger stop, and the lesser rim is spaced from the thumb wrap-preventing rim by a valley of suitable width and depth for receiving a fingernail.

Preferably, the grip body is symmetrical on each side of an x-y plane parting line. As a result, one side of the grip body includes the first longitudinally extending surface and the first thumb wrap-preventing rim, and the other side of the grip body includes a second longitudinally extending surface and a second thumb wrap-preventing rim.

Advantageously, the grip body further includes a longitudinally extending saddle comprising a seat between a distal saddle lip and an opposing proximal saddle lip that extend generally in a y-direction opposite from the elevation direction of the ridge border.

Additional advantages and beneficial features of the present invention are set forth in the drawing and detailed description, and in part will become apparent to those skilled in the art upon examination of the drawing and detailed description or may be learned by practice of the invention. In the drawing and detailed description, there is shown and essentially described only a preferred embodiment of this invention, simply by way of illustration of the best mode contemplated of carrying out this invention. As will be realized, this invention is capable of other and different embodiments, and its several details is are capable of modification in various respects, all without departing from the invention. Accordingly, the drawing and the detailed description are to be regarded as illustrative in nature, and not as restrictive.

BRIEF DESCRIPTION OF THE DRAWING

Reference is now made to the accompanying drawing which forms a part of the specification of the present invention.

DETAILED DESCRIPTION OF THE INVENTION

Figure 1:
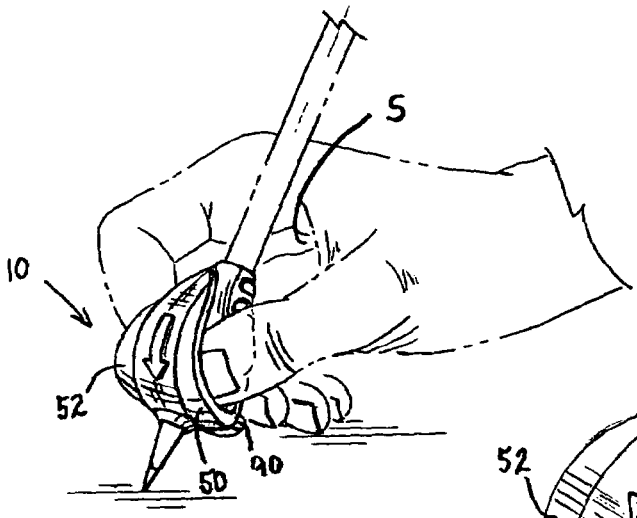
FIGS. 1, 3, 5, 7 and 11 are different perspective views of a preferred embodiment of a gripping aid in accordance with the invention, mounted on a pencil and gripped by a right hand.

In accordance with the present invention, there is provided an improved gripping aid that is mounted on a hand held instrument, to assure proper positioning of the thumb, index and middle fingers. Unlike existing gripping aids, once the thumb, index and middle fingers are in place, the gripping aid of the present invention, prevents a user from reverting to immature grasping habits. Advantageously, this improved grip prevents thumb wrap, and discourages hyperextension of finger and thumb joints.

Beneficially, a grip in accordance with the present invention, places and holds the hand in a mature tripod grasp, and discourages closing of the web space between the thumb and index finger. Advantageously, the grip assures fine motor control and dynamic movements of the tripod fingers. Thus, it is intended that the grip be mounted on hand-held instruments that require fine motor control and dynamic movements of the tripod fingers, such as a pen, pencil, crayon or x-acto knife. Furthermore, the same grip can be used by right and left handed users.

In the description of the invention, relative terms such as "upper", "underside" and the like have been used particularly with reference to the drawing to assist understanding. For simplification of the description and consistency with usage in this art, the term "finger" as used herein, sometimes means "thumb".

Referring to FIGS. 1, 3, 5, 7 and 11, a preferred grip 10 in accordance with the invention, mounted on a writing instrument shown in phantom except for the writing end of the instrument, is shown gripped by the thumb, index and middle fingers of a right hand, also shown in phantom. The fingers are beneficially placed and held by grip 10, in a natural ergonomic position that supports the joints to alleviate the need for increased pencil pressure. From these Figures, it can be seen that a gripping aid in accordance with the invention, advantageously not only assures a dynamic tripod grasp, but also, referring particularly to FIG. 11, beneficially maintains arches in the palm of the hand. In addition, referring particularly to FIGS. 1, 5 and 11, a gripping aid in accordance with the invention, advantageously maintains an open and circular web space S between the thumb and index finger. As a result, a gripping aid in accordance with the invention, assures fine motor control and dynamic movements of the tripod fingers.

Figure 4:
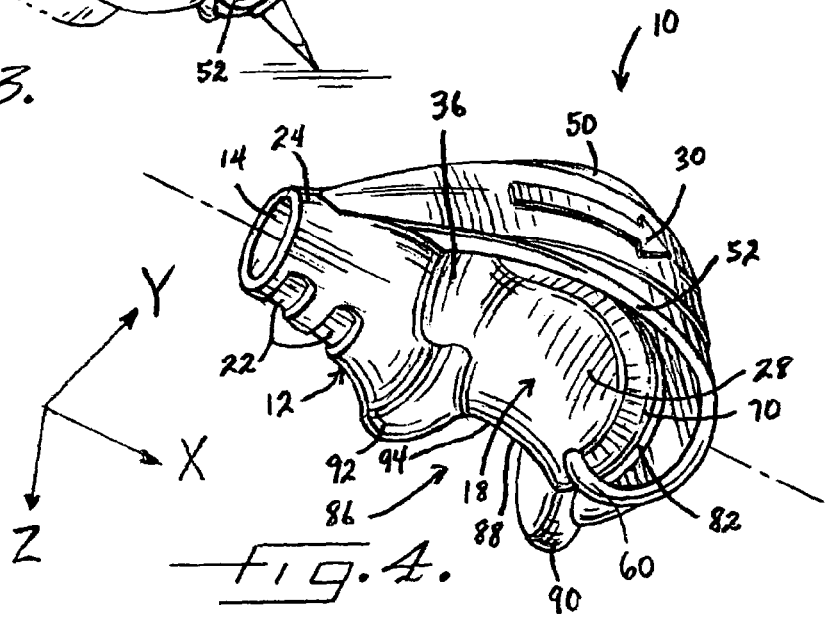
FIG. 4 corresponds to the perspective view of FIG. 3 without the pencil and right hand, and includes an x-y-z coordinate system for reference.
Figure 8:
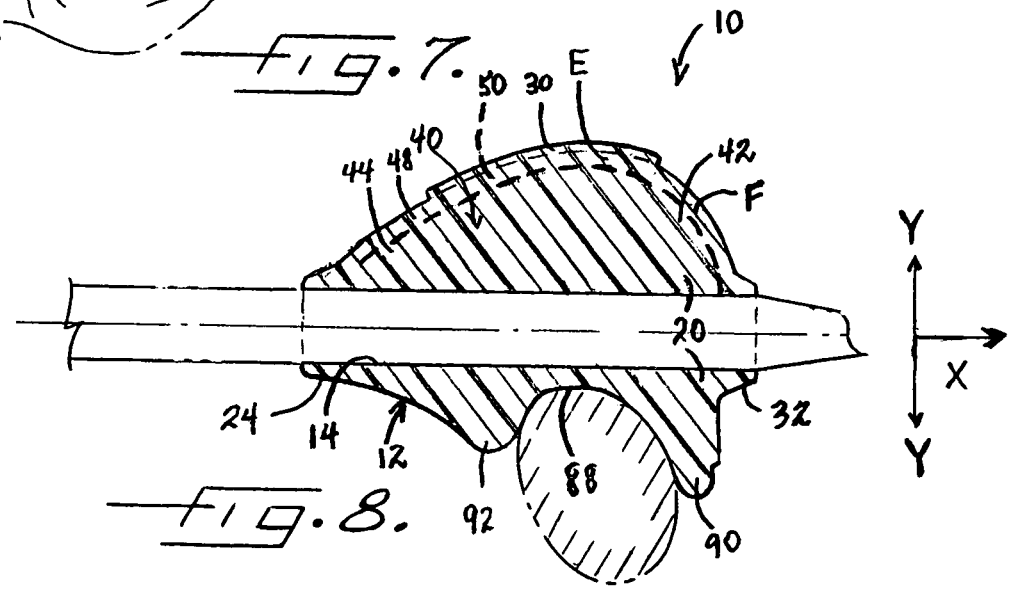
FIG. 8 is a cross-sectional view taken generally along the line 8—8 of FIG. 7, more specifically along the x-axis and through an x-y plane of the x-y-z coordinate system.
Figure 9:
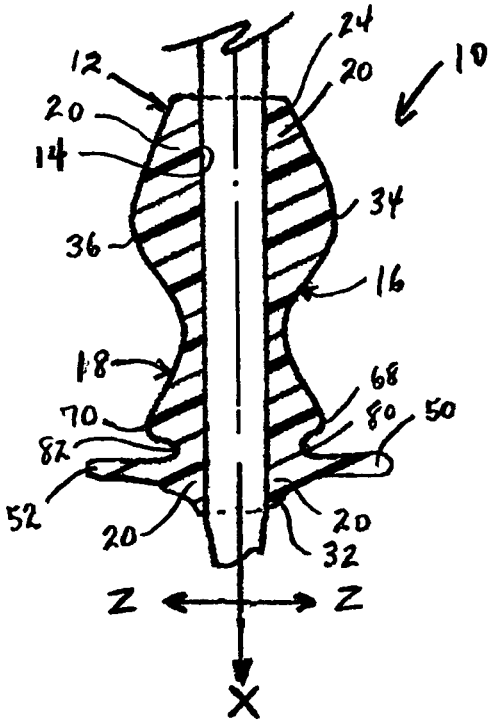
FIG. 9 is a cross-sectional view from the perspective of FIG. 5, taken along the x-axis and through an x-z plane of the x-y-z coordinate system, of the grip of FIG. 5, shown reduced in size relative to FIG. 10.

With reference now to FIGS. 2, 4, 8, 9 and 10, preferred grip 10 beneficially has an elongated body 12 provided with a mounting bore 14 (best shown in FIGS. 8 and 9) that extends through a long axis of the grip body for receiving a hand held instrument. With reference to FIGS. 4, 8 and 9, mounting bore 14 defines an x-axis of an x-y-z coordinate system, in which x, y and z are oriented perpendicular to one another.

Figure 6:
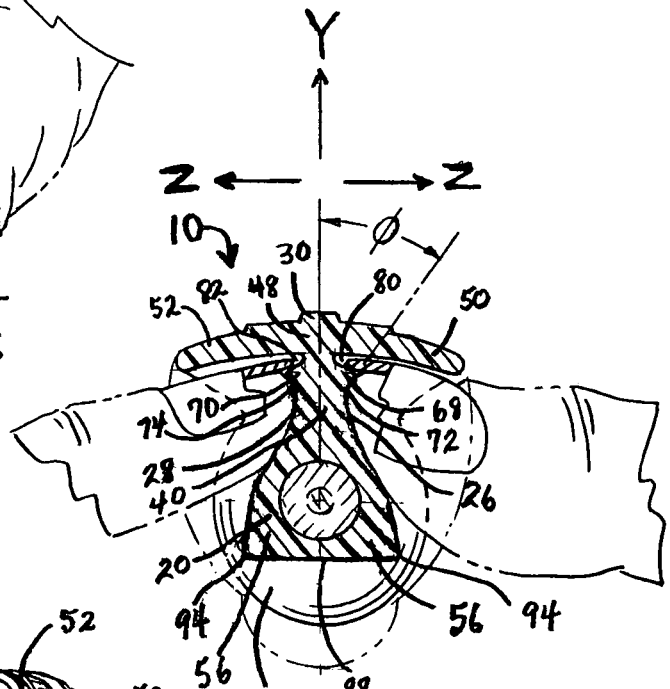
FIG. 6 is a cross-sectional view taken substantially along the line 6—6 of FIG. 5, more specifically through a y-z plane of the x-y-z coordinate system, that illustrates, inter alia, thumb and index fingernails in the nail spaces.

With continued reference to FIGS. 6, 8 and 9, a grip body portion 20 surrounds the mounting bore. Conveniently, the mounting bore is circular in cross-section and has a diameter that is slightly smaller than the outer diameter of the hand-held instrument. If desired, the mounting bore may be non-circular in cross-section, for example, hexagonal or octagonal.

Figure 2:
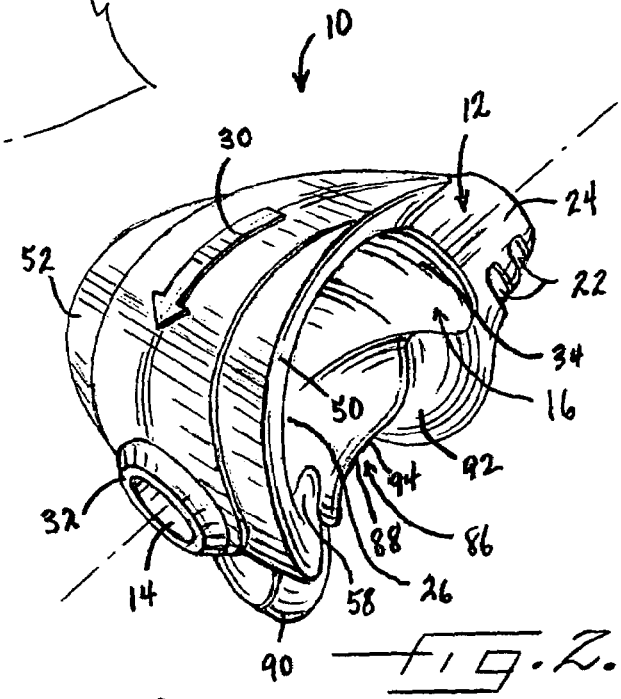
FIG. 2 corresponds to the perspective view of FIG. 1 without the pencil and right hand.
Figure 3:
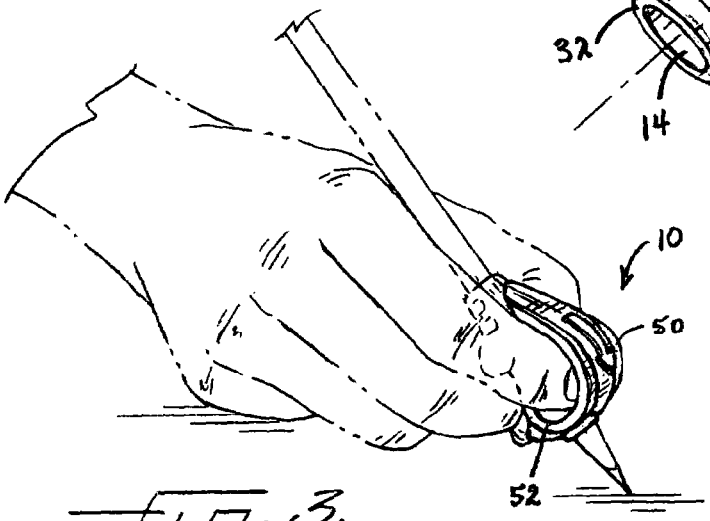
Figure 10:
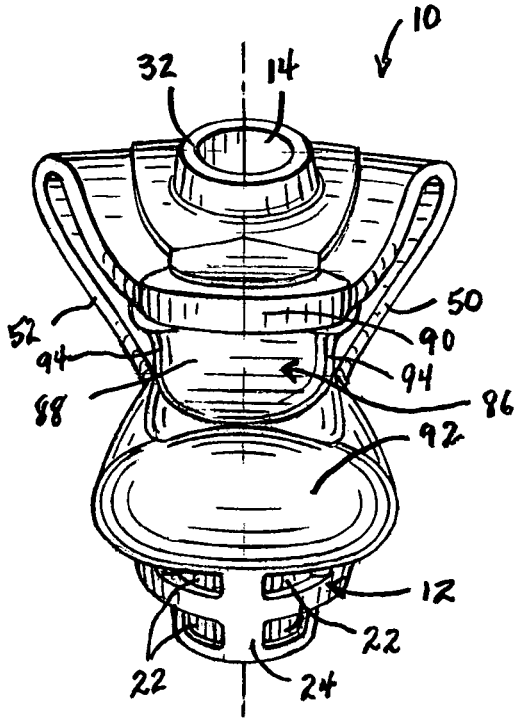
FIG. 10 corresponds to the perspective view of FIG. 11 without the pencil and right hand.
Figure 11:
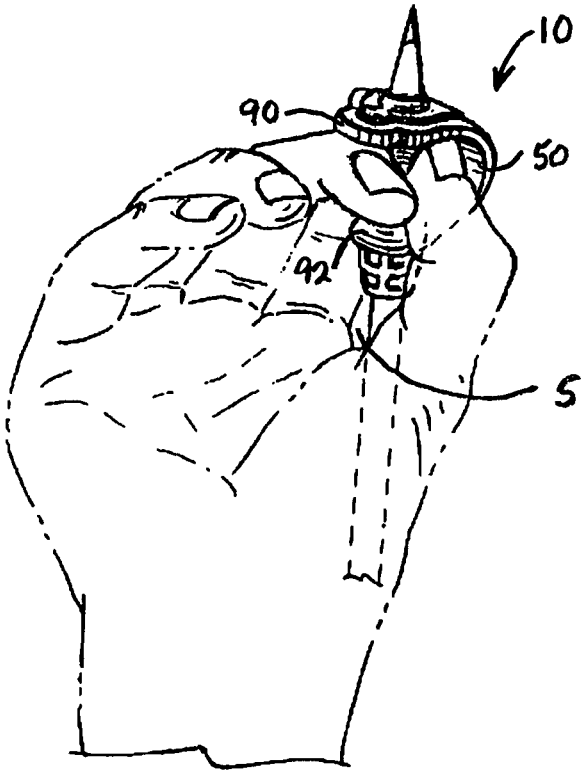
Figure 12A:
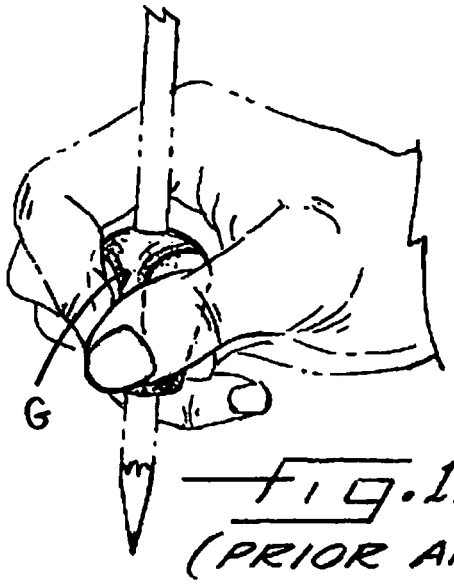
FIG. 12A. (PRIOR ART)
FIGS. 12A, 12B and 12C are perspective views illustrating improper grasp patterns allowed by a prior art pencil grip G provided with three concave surface depressions, and specifically illustrate thumb wrap (FIG. 12A), thumb internal rotation and adduction (FIG. 12B), and DIP joint hyperextension of the index finger (FIG. 12C)
Figure 12B:
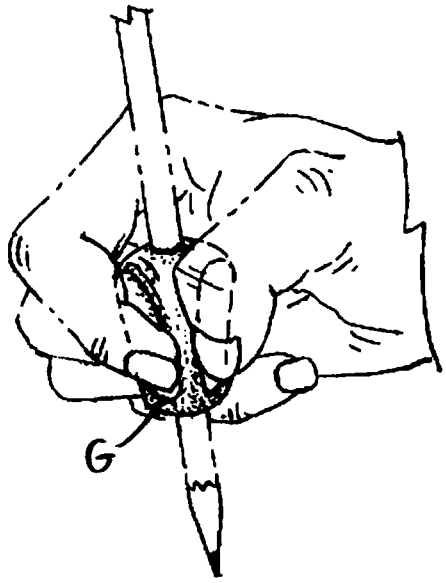
FIG. 12B. (PRIOR ART)
Figure 12C:
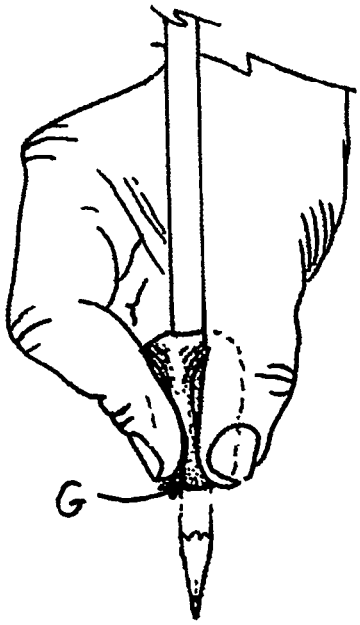
FIG. 12C. (PRIOR ART)

With reference now in particular to FIGS. 2, 4 and 10, indents 22 located at a proximal end 24 of the grip is body advantageously reduce the body weight and enhance the look of the grip. A directional arrow 30 points toward a distal end 32 of the grip body to assist a user in correct mounting of the grip on the instrument.

Although the grip body may be made from any suitable polymeric or resilient material, thermoplastic rubber is a preferred material. Conveniently, the grip may be manufactured by a molding process.

Preferably, in order to discourage hyperextension of the index finger DIP joint, the grip is manufactured from a material having an appropriate firmness. In this regard, the material should have an A scale durometer value in excess of A 30, and beneficially in the range of A 40 to A 60, or should have a comparable firmness if A scale durometer values are inappropriate for the material. By comparison, the softness of the commercially sold Pozil grip, which is believed to have an A 15 durometer value or a softness comparable to A 15, does not adequately prevent joint hyperextension.

To avoid loss of the softness necessary for comfortable feel, the material used to make a grip in accordance with the present invention, should not exceed A 70 or comparable firmness. Similarly, it is advantageous that the grip material be sufficiently resilient so that the mounting bore can expand to receive and securely hold the instrument.

With continued reference to FIGS. 2 and 4 in particular, grip body 12 includes lateral surfaces 16,18 (lateral surface 16 incompletely shown), each of which includes a generally concave surface 26,28 (only concave surface 28 is completely shown) located relatively closer to distal body end 32 than to proximal body end 24. Concave surfaces 26,28 each have a shape and size suitable for receiving a portion of the distal phalanx of the thumb or index finger.

Beneficially, each of longitudinally extending surfaces 16,18 includes a raised surface 34,36, as shown, that is relatively more elevated in the respective z-direction (see FIGS. 4 and 9 in particular) than respective generally concave surface 26,28, and that is located relatively near proximal body end 24. Advantageously, each longitudinally extending surface progressively rises in elevation in the respective z-direction from the generally concave surface to the raised surface. Beneficially, the angle and height of this rise in elevation is appropriate to rotate the thumb and index finger out to assure proper positioning of the thumb and index fingers and create an open and circular web space, and for support of thumb and index finger joints to discourage joint hyperextension.

Advantageously, to provide use of the same grip by left and right handed users, longitudinally extending surfaces 16,18 are substantially identical to one another in shape and in position on the grip body. One longitudinally extending surface provides contact with the end of a thumb and a portion of the thumb between the thumb end and the adjacent thumb joint, and supports the thumb joint, whereas the other longitudinally extending surface provides contact with the distal phalanx, and supports the DIP joint, of the index finger.

Referring again to FIG. 8, grip body 12 advantageously includes a raised ridge 40 that has a distal end 42 that has a relatively more elevated cross-section in a y-direction relative to the x-axis, than a proximal end 44 thereof. As clearly shown by FIG. 8, raised ridge 40 is progressively more elevated in the y-direction as it extends from proximal ridge end 44 toward distal ridge end 42, until it reaches a locus E of maximum elevation in the y-direction located near distal ridge end 42. As illustrated, raised ridge 40 is generally arched.

With reference also to FIGS. 2, 4, 6, 9 and 10, grip body 12 advantageously includes thumb wrap-preventing rims 50,52. Unlike the START RIGHT pencil grip, which includes thumb wrap-preventing rims, prior art such as that of the Pozil et al and Citrenbaum patents, lacks a thumb wrap-preventing rim. Thus, the term "thumb wrap-preventing rim" as used herein, is intended to distinguish over the type of prior art gripping aids illustrated by the Pozil et al and Citrenbaum patents.

Referring in particular to FIGS. 2 and 4, rims 50,52 are advantageously generally arched, and extend from a ridge border 48 generally in opposite z-directions (best understood from FIGS. 6, 8 and 9). Like ridge 40, rims 50,52 are progressively more elevated in the y-direction relative to the x-axis until reaching locus E of maximum elevation in the y-direction. In short, the elevation of rims 50,52 relative to the x-axis follows the elevation of ridge border 48 from proximal body end 24 to distal body end 32.

Beneficially, at a locus F (shown in FIG. 8) of ridge border 48 located at the distal body end, rims 50,52 become generally perpendicular to the x-axis (shown in FIG. 9), and then adjacent the respective lower portion 56 (best seen in FIG. 6) of grip body portion 20, each includes (best seen in FIGS. 2 and 4) a rearward curl 58,60 and becomes generally parallel to the x-axis again. At distal body end 32, rims 50,52 extend generally in the respective z-direction, from grip body portion 20 that surrounds the mounting bore. From the foregoing description and in particular from FIG. 4, it can be recognized that rims 50,52 have a generally ear-shaped look when viewed from the side.

Advantageously, as can be best understood from FIGS. 4, 8 and 10, rims 50,52 are the most extended in the respective z-direction approximately from locus E of maximum elevation to locus F (see FIG. 8 for locus E and is locus F), and the maximum rim extension in the respective z-direction exceeds the maximum elevation of respective raised surface 34,36 in the respective z-direction. Furthermore, from locus E toward proximate ridge end 44, and also from locus F toward and including the respective rearward curl, extension of rims 50,52 in the respective z-direction progressively decreases. Also, as can be understood from FIG. 6, as rims 50,52 extend in opposite z-directions from ridge border 48, particularly between locus E and locus F, each rim slopes gently toward the x-axis.

As can further be understood from FIGS. 4, 6, 8 and 9, rims 50,52 form a border of longitudinally extending surfaces 16,18. Thus, longitudinally extending surfaces 16,18 and rims 50,52 cooperate to assure proper placement of the thumb and index fingers by, inter alia, preventing thumb wrap and discouraging joint hyperextension.

With continued reference to FIGS. 4, 6 and 9, generally concave surfaces 26,28 each beneficially lead to, and are bordered by, a lesser rim 68,70 that extends generally in the respective z-direction only a short distance, for example, approximately one-sixteenth inch. As best understood from FIG. 4, each of these lesser rims has a contour that generally follows the contour of respective rim 50,52 until each intersects with respective rim curl 58,60 (intersection of lesser rim 70 with rim curl 60 shown).

Referring particularly to FIGS. 6 and 9, lesser rims 68,70 advantageously serve as finger stops, and each of concave surfaces 26,28 rises in the direction of its respective rim 50,52 to form the respective finger stop, and each finger stop is provided with a lower slope 72,74 defined by an angle $\Phi$ from the y-axis (only the angle $\Phi$ for lower slope 72 of rim 68 is depicted). Advantageously, the angle $\Phi$ is in the range of from about 30 to 50° for comfort and effect.

Figure 5:
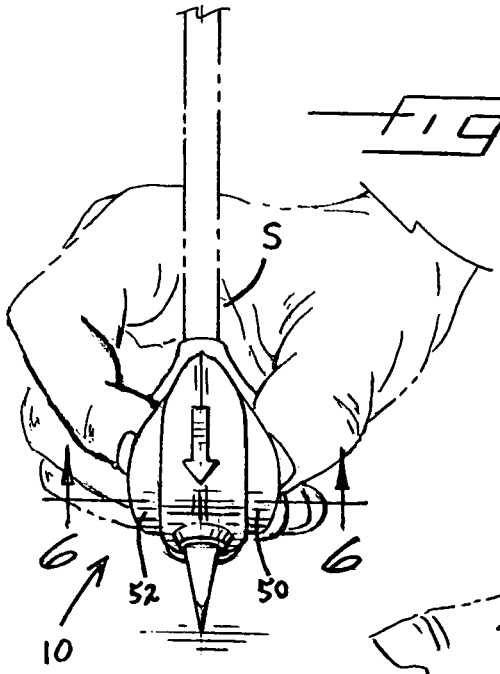

With continued reference to FIGS. 6 and 9, each finger stop 68,70 is spaced apart from respective rim 50,52 by a respective valley 80,82 of longitudinally extending surfaces 16,18. Valleys 80,82 each have a depth and a width (defined by distance between rims 50,52 and the respective finger stop) suitable for receiving a thumbnail or index finger nail, as the case may be. As can be understood from comparison of FIGS. 5 and 6, FIG. 6 does not illustrate a thumb and index finger in the same angled relationship to the grip body as is shown in FIG. 5. Instead, FIG. 6 depicts, for sake of illustration, a thumb and index finger in an angled relationship that makes clear the use of valleys 80,82 for receiving nails.

Referring now to FIGS. 2, 4, 8 and 10 in particular, an underside of grip body 12 advantageously includes a longitudinally extending saddle 86 for receiving the middle finger at an about 90° angle to the long axis of the grip body, and holding the finger in place. Beneficially, saddle 86 includes a seat 88 between a distal saddle lip 90 and an opposing proximal saddle lip 92, which generally extend in a y-direction opposite from (see FIG. 8) the y-elevation direction of rims 50,52 ("the opposite y-direction"). Advantageously, distal saddle lip 90 extends further than proximal saddle lip in the opposite y-direction.

Figure 7:
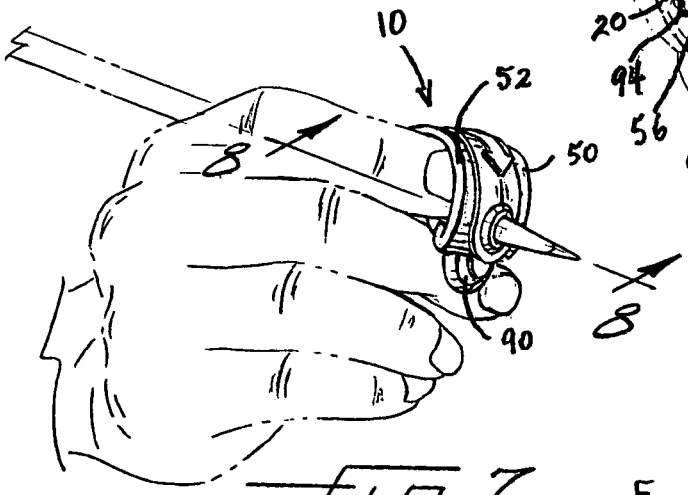

Beneficially, the space defined by opposing saddle lips 90,92 for the middle finger, is selected to be sufficiently tight for stabilization and control, and proximal saddle lip 92 is ergonomically curved to provide natural, supported feel. Saddle 86 supports the DIP joint of the middle finger on both the palmar and dorsal surfaces, providing kinesthetic feedback to the joint, which serves as the stable base of the tripod grasp during movement. Thus, as shown in FIG. 7, it is intended that the DIP joint of the middle finger be held and remain between the opposing saddle lips during movement.

Advantageously, distal saddle lip 90 extends forwardly at an about 20 to 40° angle from the y-axis. With reference particularly to FIG. 10, it can be recognized that the portion of the grip body defined by rims 50,52 and the forwardly extending distal saddle lip, has the look of a head of a cobra poised to strike.

With reference particularly to FIG. 8, seat 88 is elevated the least in the opposite y-direction of any portion of the saddle. Advantageously, distal saddle lip 90 generally underlies distal ridge end 42, and seat 88 generally underlies the portion of raised ridge border 48 that is the most elevated in the y-direction.

From the foregoing and with reference again to FIG. 6, it can be understood that an upper surface portion (which includes lesser rims 68,70 and valleys 80,82) of each of longitudinally extending surfaces 16,18 is formed in a face of raised ridge 40, and that the longitudinally extending surfaces are in an appropriately spaced apart relationship from one another. Further, it can be understood that the longitudinally extending surfaces each intersect with seat 88 at the respective seat lateral edge 94. With reference also to FIG. 4, each longitudinally extending surface beneficially includes a y-z plane cross-section that decreases in elevation in the respective z-direction from the respective lateral edge 94 of seat 88 until the respective generally concave surface (26 or 28) rises in elevation to form the respective finger stop.

Figure 13:
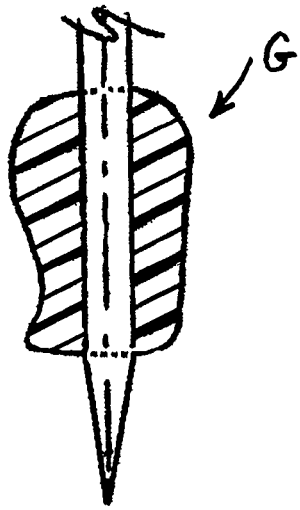
FIG. 13. (PRIOR ART)
FIG. 13 is a cross-sectional view similar to that of FIG. 9, of the prior art pencil grip of FIG. 12.

As can be appreciated by consideration of the foregoing description and the drawing, grip body 12 is beneficially symmetrical on each side of an x-y plane parting line. This symmetry benefits use by both left and right handed users. Referring to FIG. 13, comparison can be made between FIG. 9 and the body of the asymmetric Pozil grip.

The present invention may be carried out with various modifications without departing from the spirit or essential attributes thereof, and accordingly, reference should be made to the appended claims, rather than to the foregoing specification as indicating the scope of the invention.

The invention claimed is:

1. A gripping aid for a hand held instrument comprising a grip body provided with a bore for receiving the instrument, wherein said bore defines an x-axis of an x-y-z coordinate system, wherein said grip body comprises a first longitudinally extending surface comprising a generally concave surface located relatively near a distal end of said grip body, and a relatively more elevated, raised surface located relatively near a proximal end of said grip body, wherein said grip body further comprises a first generally arched, thumb wrap-preventing rim that extends generally in a z-direction from a border of a raised ridge, and the ridge border increases in elevation in a y-direction relative to said x-axis from said proximal body end toward said distal body end.

2. The gripping aid of claim 1, wherein said first thumb wrap-preventing rim has a locus of maximum elevation in said y-direction relatively closer to said distal body end than to said proximal body end.

3. The gripping aid of claim 2, wherein said first thumb wrap-preventing rim is the most extended in said z-direction approximately from said locus of maximum elevation to a locus at which said rim becomes generally perpendicular to said x-axis.

4. The gripping aid of claim 1, wherein said first thumb wrap-preventing rim increases in the extension in said z-direction, from said proximal body end toward said distal body end.

5. The gripping aid of claim 1, wherein at said distal body end, said first thumb wrap-preventing rim comprises a rearward curl and extends generally in said z-direction from a grip body portion that surrounds the mounting bore.

6. The gripping aid of claim 1, wherein said generally concave surface rises in the direction of said first thumb wrap-preventing rim to form a lesser rim that extends generally in said z-direction a shorter distance than said thumb wrap-preventing rim extends.

7. The gripping aid of claim 6, wherein said first thumb wrap-preventing rim extends generally in said z-direction from a grip body portion that surrounds the mounting bore, and comprises a rearward curl, and said lesser rim intersects said rearward curl.

8. The gripping aid of claim 1, wherein said grip body further comprises a longitudinally extending saddle comprising a seat between a distal saddle lip and an opposing proximal saddle lip that extend generally in a y-direction opposite from the elevation direction of said ridge border.

9. The gripping aid of claim 8, wherein the saddle seat comprises lateral edges, and said first longitudinally extending surface comprises a y-z plane cross-section that decreases in elevation in said z-direction from the respective lateral edge of said saddle seat until said generally concave surface of said first longitudinally extending surface, rises in elevation to form a finger stop.

10. The gripping aid of claim 1, wherein an underside of said grip body comprises a middle finger position area.

11. The gripping aid of claim 1, wherein said grip body is symmetrical on each side of an x-y plane parting line such that one side of said grip body comprises said first longitudinally extending surface and said first thumb wrap-preventing rim, and the other side of said grip body comprises a second longitudinally extending surface and a second generally arched, thumb wrap-preventing rim.

12. A gripping aid for a hand-held instrument comprising a grip body provided with a bore for receiving the instrument, wherein said bore defines an x-axis of an x-y-z coordinate system, wherein said grip body comprises a first longitudinally extending surface comprising a generally concave surface located relatively near a distal end of said body, wherein said grip body further comprises a first thumb wrap-preventing rim that extends generally in a z-direction from a border of a raised ridge, and the ridge border is elevated in a y-direction relative to said x-axis, and wherein said generally concave surface rises in the direction of said thumb wrap-preventing rim to form a lesser rim that extends generally in said z-direction a shorter distance than said thumb wrap-preventing rim extends.

13. The gripping aid of claim 12, wherein said grip body further comprises a longitudinally extending saddle comprising a seat between a distal saddle lip and an opposing proximal saddle lip that extend generally in a y-direction opposite from the elevation direction of said ridge border.

14. The gripping aid of claim 12, wherein an underside of said grip body comprises a middle finger position area.

15. A gripping aid for a hand-held instrument comprising a grip body provided with a bore for receiving the instrument, wherein said bore defines an x-axis of an x-y-z coordinate system, wherein said grip body comprises a first longitudinally extending surface comprising a generally concave surface located relatively near a distal end of said body, wherein said grip body further comprises a first generally arched, thumb wrap-preventing rim and a second generally arched thumb wrap-preventing rim that extend from a border of a raised ridge generally in opposite z-directions, wherein said raised ridge comprises a proximal ridge end and a distal ridge end, and the ridge border is elevated in a y-direction relative to said x-axis, and wherein said first generally arched, thumb wrap-preventing is rim and said second generally arched, thumb wrap-preventing rim increase in extension in said opposite z-directions from said proximal body end toward said distal body end.

16. The gripping aid of claim 15, wherein said generally concave surface rises in the direction of the respective thumb wrap-preventing rim to form a lesser rim that extends generally in the respective z-direction a shorter distance than the respective thumb wrap-preventing rim extends.

17. The gripping aid of claim 15, wherein an underside of said grip body comprises a middle finger position area.

* * * * *

UNITED STATES PATENT AND TRADEMARK OFFICE

CERTIFICATE OF CORRECTION

PATENT NO. : 7,128,484 B2
APPLICATION NO. : 11/154552
DATED : October 31, 2006
INVENTOR(S) : Toni M. Schulken It is certified that error appears in the above-identified patent and that said Letters Patent is hereby corrected as shown below:

Title page,
Item (73), "Assignee", "Pathways for Learnung Products, Inc., Charlotte, N.C. (US)" should read "Pathways for Learning Products, Inc., Charlotte, N.C. (US)"

Claim 15, column 10,
Line 7, delete "is" prior to "rim".

Signed and Sealed this

Twentieth Day of April, 2010

David J. Kappos

David J. Kappos
*Director of the United States Patent and Trademark Office*